United States Patent [19]

Denison

[11] 4,130,169

[45] Dec. 19, 1978

[54] DOWNHOLE CONNECTOR FOR USE WITH DRILL STRING TELEMETERING SYSTEM

[75] Inventor: Early B. Denison, Houston, Tex.

[73] Assignee: Shell Oil Company, Houston, Tex.

[21] Appl. No.: 790,158

[22] Filed: Apr. 22, 1977

[51] Int. Cl.[2] ..... E21B 1/10; E21B 47/02

[52] U.S. Cl. ..... 175/299; 166/65 R; 175/45; 175/304

[58] Field of Search ..... 175/299, 304, 45, 104; 166/66, 65 R, 178; 294/86.23; 339/91 R

[56] References Cited

U.S. PATENT DOCUMENTS

| | | | |
|---|---|---|---|
| 2,309,310 | 1/1943 | Gratehous | 294/86.23 X |
| 3,152,829 | 10/1964 | Steele | 294/86.23 |
| 3,373,817 | 3/1968 | Cubberley, Jr. | 166/65 R |
| 3,406,770 | 10/1968 | Arterbury et al. | 175/229 |
| 3,696,332 | 10/1972 | Dickson, Jr. et al. | 175/104 |

*Primary Examiner*—Ernest R. Purser
*Assistant Examiner*—William F. Pate, III

[57] ABSTRACT

A remotely operated connector for electrically and mechanically coupling a wireline to a connector located at the bottom of a drill string. The connector includes a spring-actuated jar that facilitates the release of the connector.

16 Claims, 5 Drawing Figures

DOWNHOLE CONNECTOR FOR USE WITH DRILL STRING TELEMETERING SYSTEM

RELATED APPLICATIONS

The present application is related to a copending application entitled "DRILL STRING TELEMETERING SYSTEM," Ser. No. 753,768, filed Dec. 27, 1976.

BACKGROUND OF THE INVENTION

In the above-referenced copending application, there is disclosed a system for telemetering instrument information from the bottom of a borehole adjacent the drill bit to the surface while drilling the borehole. Particularly, the system utilizes a wireline to transmit the information from the point adjacent the drill bit to an intermediate point on the drill string. From the intermediate point the information is transmitted to the surface, utilizing a special drill string, each section of which is provided with a conductor which terminates in special contacts in the thread joints of each section. The special contacts mate when the drill string is made up to complete the electrical system. The system also includes a remotely-operated downhole connector which can be attached to the wireline prior to installing the wireline in the drill string. The connector is designed so that as the wireline is lowered into the drill string, it makes contact with its companion connector in the instrument package adjacent the drill bit. After contact is made, tension can be applied to the wireline to lock the connector to its companion connector in the instrument package. When it is desired to remove the wireline from the drill string, the tension is removed and the downhole connector operates so that it is released from its companion connector and the wireline removed. The downhole connector includes provisions to control its operation so that the connector can be repeatedly locked and released from its companion connector by applying and releasing tension on the wireline.

While the downhole connector in the copending application has proven satisfactory, at times it fails to release when desired. Its failure to release usually occurs after the system has been rotated in the borehole for several hours. Failure of the connector to release means that the tension or pull on the wireline must be increased until the terminal socket on the wireline adjacent the connector fails or the wireline breaks. This is, of course, undesirable since it means that the wireline socket must be reinstalled on the wireline and the wireline will be reduced in overall length. In addition, there is a possibility that the sudden release of the tension on the wireline will cause the wireline to rebound in the drill string and possibly, tangle itself to the extent that it will necessitate the physical removal of the wireline. This can be a costly operation since it may be necessary to cut the wireline as each individual section of the drill string is removed and physically remove the wireline. Further if the drill string is stuck in the borehole, and the wireline breaks and tangles in the drill string, it will be impossible to clear the drill string so that tools may be lowered through the drill string.

BRIEF DESCRIPTION OF THE INVENTION

It has been discovered that the above problem of non-releasing of the downhole connector can be solved if it is possible to apply a sharp, downward force, or hammer blow along the axis of the connector. It is believed that the sharp force breaks the surface tension between the tapered surfaces of the collet fingers and the operating member to release the connector. Accordingly, the present invention provides a jar means which can be actuated by manipulating the wireline to apply sharp, longitudinal impacts or blows to the downhole connector. Further, the jar means is attached directly to the downhole connector and forms a integral part thereof.

The jar means comprises a mass or jar member which is driven by a compression spring to apply the sharp impacts, or blows, to the connector. The compression spring is compressed by applying tension to the wireline and the mass is retained in the cocked position by a latch, or trigger, means. When it is desired to trip the mass so that the sharp, longitudinal impact can be applied to the connector, the tension on the wireline is released which operates the trigger to apply the sharp blow. A single electrical conductor extends from one end of the jar means to the opposite end.

In addition, the connector is of a modified form in which a single, flexible electrical cable provides the internal connection between the ends of the connector in place of the solid, telescoping rods, shown in the prior application.

BRIEF DESCRIPTION OF THE DRAWINGS

The present invention will be more easily understood from the following detailed description when taken in conjunction with the attached drawings, in which.

PREFERRED EMBODIMENT

Figure 1:
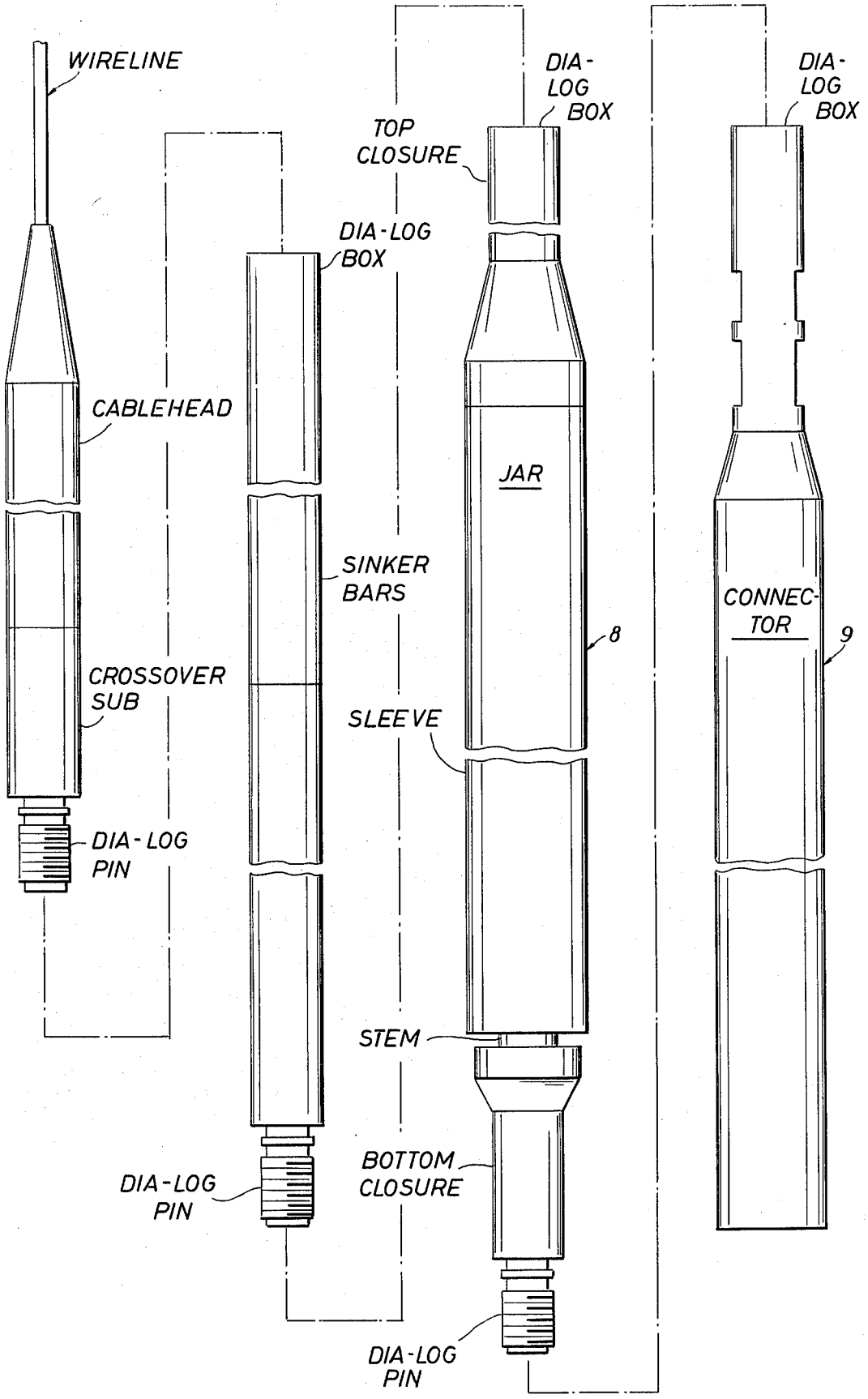
FIG. 1 is an elevation view of the complete jar-connector assembly.

Shown in FIG. 1 is the complete downhole assembly comprising the crossover sub, sinker bars, jar means 8, and downhole connector 9 with the wireline terminating in a cable head that threads into the crossover sub. The crossover sub has an electrical connector in one end that mates with an electrical connector in the cable head and a second electrical connector in its other end mates with the electrical connector in a sinker bar. Cable heads are commercially available from Gearhart-Owen of Fort Worth, Texas. Sinker bars are modified commercially available items from the Dia-Log Company of Houston, Texas. The sinker bars thread into the upper end of the jar means with the jar means being threadably connected to the connector. All of the threaded connections include electrical contacts that cooperate with electrical conductors to establish an electrical circuit through the assembly and may comprise commercial units available from Dia-Log.

Figure 2:
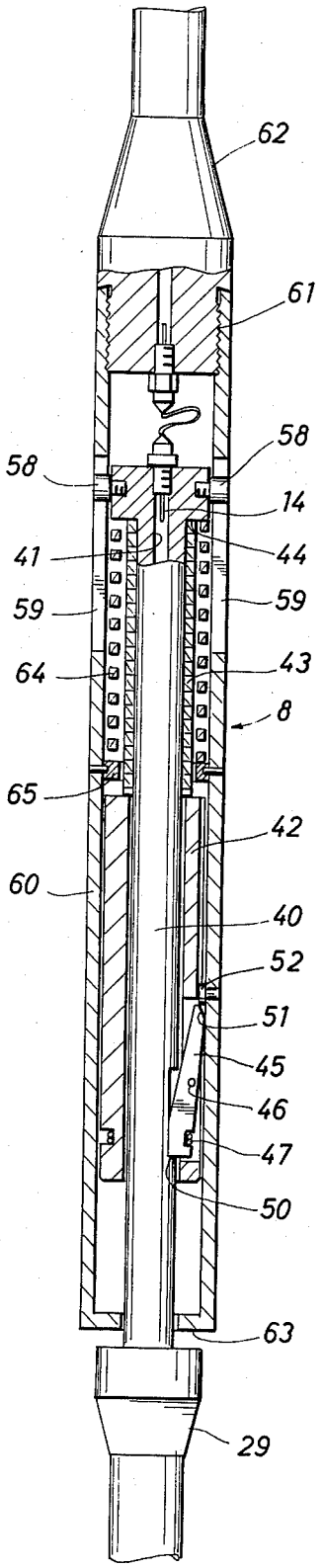
FIG. 2 is an elevation view of the jar means, shown after cocking, just before tripping the latch.
Figure 3:
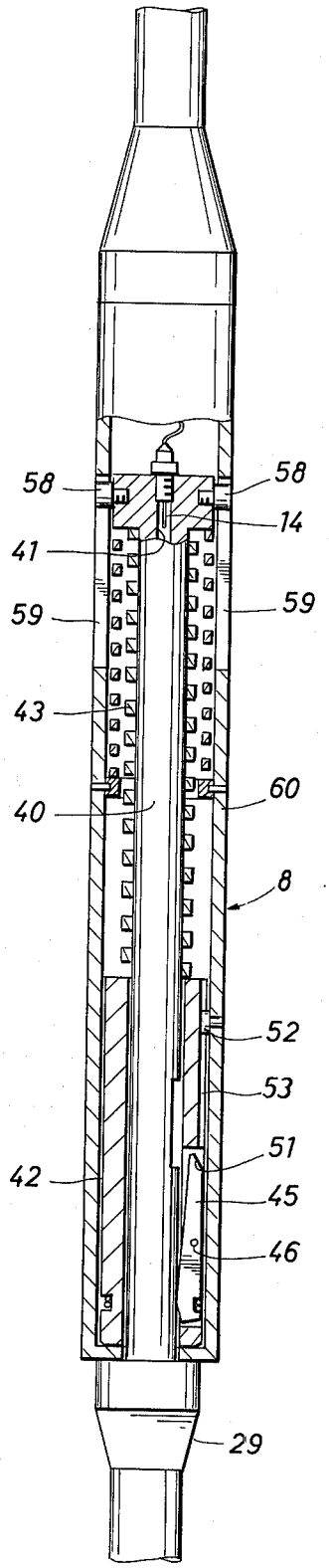
FIG. 3 is an elevation view of the jar means, shown in the released or operated position.
Figure 4A:
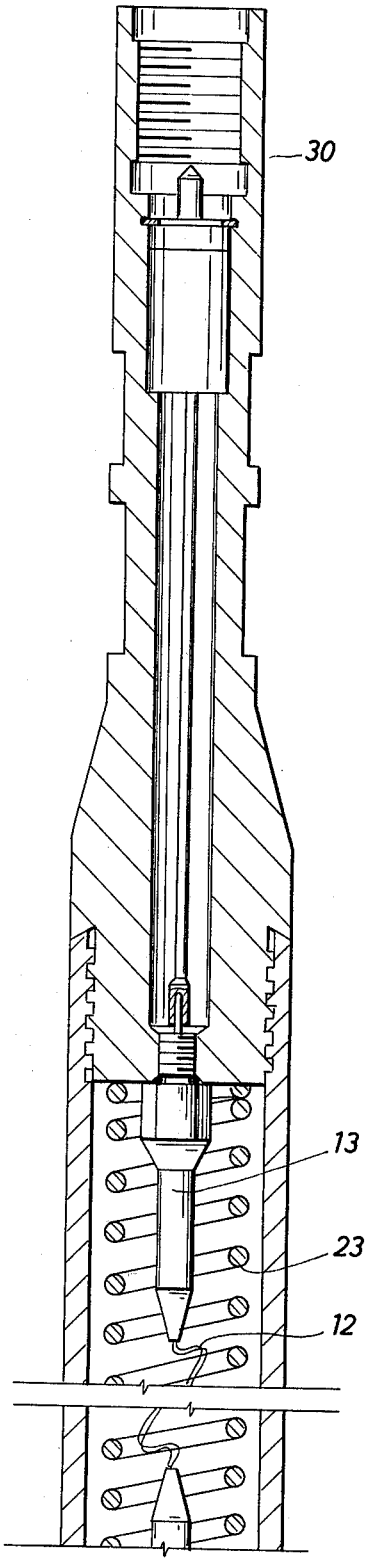
FIG. 4 is an elevation view of the modified connector.
Figure 4B:
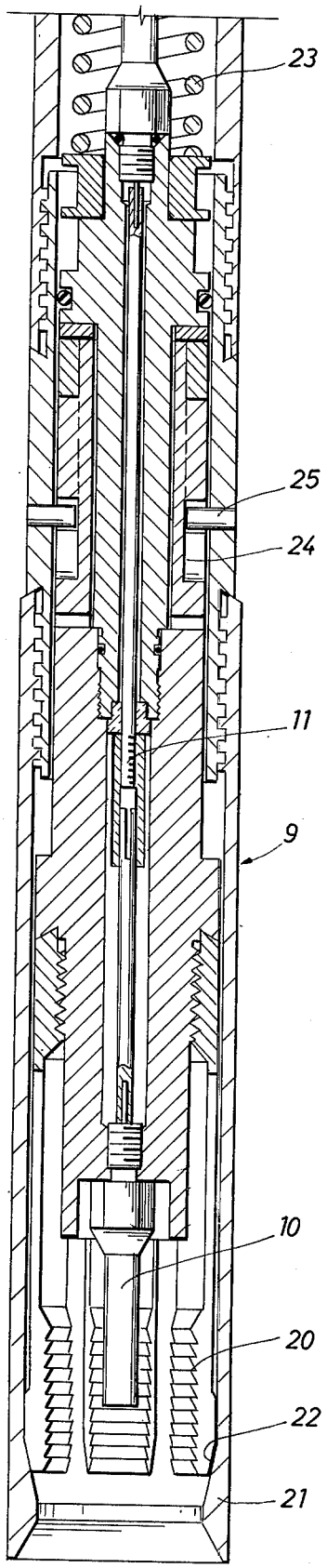

Referring now to FIGS. 2 and 3, the jar means 8 comprises an elongated, central support member 40 securely attached to the bottom closure 29 which in turn mates securely to the upper end 30 of the connector, shown in FIG. 4. The support member is provided with a central passageway 41 in order that a cable from the Dia-Log contact in the end closure 29 may be joined with a Dia-Log contact in the top closure 62 of the jar means. This provides an electrical circuit through the jar means and completes the circuit from the cable head to the connector. A cylindrical mass 42 is disposed to slide longitudinally along the support member 40 and forms the hammer or jar which applies the longitudinal impact of the jar means. The mass or hammer is driven downwardly by a compression spring 43, which is disposed around the support member and reacts against the surface 44 of the flange at the upper end of the support member. A trigger, consisting of a latch 45 and trigger pin 52, retains the mass in the cocked position as shown in FIG. 2. The latch is pivotedly mounted on the hammer by means of a pin 46, and biased inwardly by means of a garter spring 47 disposed in a circumferential groove formed in the outer surface of the mass, and a similar groove formed in the latch. As shown in FIG. 2, the lower end of the latch cooperates with a recess 50 formed in the central support member to hold the mass in a cocked position.

The latch is released by means of a trigger pin 52 mounted on the inner surface of the cylindrical operating member 60 that surrounds the jar means, as shown. The trigger pin 52 operates in a slot 53 in the cylindrical mass 42. This pin slot combination maintains alignment between the trigger pin 52 and the latch 45 as well as between the latch 45 and the recess 50. The operating member can be longitudinally moved over a restricted distance by applying or releasing the tension on the wireline. The rotation and longitudinal travel of the operating member is controlled by a combination of longitudinal slots 59 formed in the wall of the operating member and guide pins 58. The guide pins 58 are attached to the enlarged head portion of the support member 40 and cooperate with the longitudinal slots 59 to both guide and restrict the motion of the operating member. The operating member is provided with sifficient longitudinal movement to insure that its lower end 63 contacts the end closure 29, as shown in FIG. 3.

The upper end of the operating member is attached to the top closure 62 while the lower end of the operating member is provided with an inwardly-extending radial flange 63. The radial flange serves to retain the mass within the interior of the jar, and in addition, provides a means by which the mass can be moved to its cocked position. The operating member is biased downwardly by means of a compression spring 64 which surrounds the compression spring 43 used for driving the mass. The compression spring 64 reacts against a ring member 65 at its lower end and against the flange 44 at its upper end.

Referring to FIG. 4, the downhole connector includes a female connector 10, which mates with the male connector disposed on the downhole instrument package as shown in the copending application. The connector 10 is coupled by means of an insulated rod member 11 to a cable 12, which terminates in a female connector 13 at the upper end of the downhole connector. The female connector is coupled to a male connector, which in turn, is coupled to a insulated rod member that passes upward to the upper end 30 of the connector. The second rod member is coupled to a Dia-Log contact, positioned in the upper end 30 of the connector, that mates with its companion contact in the male thread of the bottom closure 29 of the jar means.

The downhole connector includes a series of collet fingers 20, which are designed to securely grip or lock on a fishing neck that forms a part of the downhole instrument package (not shown in FIG. 4). The collet fingers are mounted on an inner support member that is spring biased in a downward direction. The collet fingers are moved radially inward to a gripping position, by means of the inclined surface 22 on the lower end of the operating member 21. As explained in the copending application, by applying tension to the wireline, the operating member 21 is moved upwardly to force the collet fingers inwardly. When tension is released, the operating member is forced downwardly, by the weight of the sinker bars disposed above the jar means. On reapplication of tension of the wireline, the operating member 21 is prevented from moving upwardly with respect to the collet fingers by means of the cam arrangement formed by the cam slot 24 and cam pin 25. The operation of the cam means is more fully described in the copending application and is shown and described on the overshot tool offered for sale by Taylor Made Oil Tools of Houston, Texas.

As is easily seen from the drawings, the jar means is operated by applying tension to the wireline to pull the operating member upwardly. As the operating member moves upward, the flange 63 at its lower end contacts the mass member 42, and moves it into the cocked position and compresses the spring 43, as shown in FIG. 2. After the spring 43 is fully compressed, the tension applied to the wireline will securely lock the downhole connector to the fishing neck and companion connector disposed on the downhole instrument package. The operation of locking and releasing the downhole connector from the fishing neck on the downhole instrument sub is more fully described in the copending application. When it is desired to apply an impact to the downhole connector, the tension on the wireline is released and the operating member will be moved downwardly by the combination of the weight of the sinker bars and the spring 64. When the operating member has moved a sufficient distance, the pin 52 will contact the sloping surface 51 on the upper end of the latch means and trip the latch. Upon tripping the latch, the mass 42 will be driven, downwardly, by the compressed spring 43 and apply the sharp impact to release the downhole connector.

If the connector is not released on the first jar, additional jars, or impacts, can be applied by recocking the jar and again, releasing the latch means. After the downhole connector has released from the fishing neck and its companion connector, the complete wireline assembly may be removed from the drill string.

While the combination connector and jar means has been described in combination with a particular drill string telemetering system, it obviously has many other applications. For example, it could be used with a telemetering system in which a wireline extends from the bottom of the borehole to the surface and no special drill pipe was used. Also, it can be adapted for transmitting multiple-phase power down a borehole to power equipment disposed in the borehole. The equipment may be a downhole drilling motor or a downhole pump used in pumping the production to the surface. The connector can be used in any application where it is necessary to remotely couple and uncouple an electrical connector from a remotely located connector. Of course, it must be possible to lower the connector by gravity or other means, such as pumping it down a hole, in order to remotely connect and disconnect the connector from its remote companion connector.

I claim as my invention:

1. A combination remotely-operable connector and jar means for both electrically and mechanically coupling a wireline to a remote companion connector located in a drill string, said connector comprising:

a support member;

a plurality of collet fingers mounted on said support member, said collet fingers being movable between first and second positions, in one position said collet fingers being engaged with a fish neck formed on said companion connector; and in the second position, the collet fingers being disengaged from said fish neck;

one-half of an electrical connector mounted on said support member, and disposed to electrically couple with the mating half of the electrical connector mounted on said companion connector;

an operating member mounted on said support member and axially movable relative to said support member, said operating member having a tapered surface disposed adjacent said collet fingers, said tapered surface moving said collet fingers to an engaged position with respect to said fish neck when said operating member is moved axially;

cam means mounted on said support member and disposed to control the axial movement of said operating member between two preset limits, one of said limits allowing movement of said collet fingers to said first position and the other of said limits allowing movement of said collet fingers to said second position, said cam means being operable by sequentially applying and releasing tension on said wireline;

spring-actuated down jar means, said jar means being coupled to said operating member, said jar means being cocked by applying tension to said wireline and tripped by releasing tension from said wireline; and an electrical cable disposed to pass through said support and operating members, said cable being coupled at one end to said one-half of the electrical connector and at the other end to a second electrical cable, said second electrical cable disposed to pass through said jar means and electrically couple to said wireline.

2. The combination connector and jar means of claim 1, and in addition, at least one sinker bar, said sinker bar being coupled to said jar means and said wireline being coupled to said sinker bar, said sinker bar including an electrical circuit adapted to be coupled to said second electrical cable at one end and said wireline at the other end.

3. The combination connector and jar means of claim 2, and in addition, the connections between said operating member and said jar means, said jar means and said sinker bars, and said sinker bars and said wireline being threaded connectors including electrical contacts.

4. The combination connector and jar means of claim 1, wherein said collet fingers are moved to an engaged position by applying tension to said wireline.

5. The combination connector and jar means of claim 4, wherein said jar means comprises an elongated support member, a mass disposed on said support member to move axially with respect to said support member, an operating member disposed on the support member to move axially with respect to said support member, spring means disposed to move said mass axially with respect to said support member, said operating member being disposed to compress said spring when tension is applied to said wireline and release the spring when said tension is released.

6. The combination connector and jar means of claim 5, wherein said support member comprises an elongated rod and said mass comprises a member disposed to slide on said rod, said operating member comprising a cylindrical member disposed to surround said mass, and move axially with respect to both the elongated rod and said mass in response to the tension applied to wireline, and a latch means mounted on said mass and operable by the axial movement of said operating member to release the spring when the tension on the wireline is released.

7. The combination connector and jar means of claim 6, and in addition, a second spring disposed to force said operating member downward to trip said latch means when the tension on the wireline is released.

8. The combination connector and jar means of claim 7, wherein both said first-mentioned and said second-mentioned springs are compressed by applying tension to said wireline.

9. The combination connector and jar means of claim 6, wherein said spring is compressed and said latch means is set to retain said spring compressed by applying tension to said wireline.

10. The combination connector and jar means of claim 9, wherein said latch means is tripped by removing tension from said wireline.

11. A wireline-operated jar adapted to apply a downward impact to a stationary member to which said jar is secured said jar comprising:

a support member adapted to be attached to said stationary member;

a jar member disposed to more axially on said support member;

a compression spring disposed to drive said jar downward to produce said downward impact on said stationary member;

an operating means for tripping a latch means, said operating means disposed to be coupled to the wireline and compress said spring when tension is applied to the wireline; and, latch means disposed to hold said compression spring in a compressed state as long as tension is applied to the wireline said latch means being released when said tension is released, whereby said spring will drive said jar member downwardly to impact upon said stationary member.

12. The jar means of claim 11 wherein said support member comprieses an elongated rod, said jar member comprises a mass disposed to slide on said rod and said operating member comprising a cylindrical member disposed to surround said jar member and move axially with respect to both said elongated rod and said jar member in response to the tension applied to the wireline, and said latch means being mounted on said jar member and operable by the axial movement of said operating member to release the spring when the tension on the wireline is released.

13. The jar means of claim 12, and in addition, a second spring disposed to force said operating member downward to trip said latch means when the tension on the wireline is released.

14. The jar means of claim 13 wherein both said first and second mentioned springs are compression springs desposed to be compressed by applying tension to the wireline.

15. The jar means of claim 11 wherein said spring is compressed and said latch means is set to retain said spring compressed by applying tension to the wireline.

16. The jar means of claim 15 wherein said latch means is tripped by releasing tension from the wireline.

* * * * *